US009805882B2

(12) United States Patent
Jeon

(10) Patent No.: US 9,805,882 B2
(45) Date of Patent: Oct. 31, 2017

(54) LOCKING DEVICE FOR OPERATING MECHANISM OF GAS INSULATED SWITCHGEAR

(71) Applicant: LSIS CO., LTD., Gyeonggi-do (KR)

(72) Inventor: Seongho Jeon, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/161,129

(22) Filed: May 20, 2016

(65) Prior Publication Data

US 2016/0379769 A1 Dec. 29, 2016

(30) Foreign Application Priority Data

Jun. 24, 2015 (KR) ..... 20-2015-0004227 U

(51) Int. Cl.

| | |
|---|---|
| ***H01H 9/28*** | (2006.01) |
| ***H01H 3/20*** | (2006.01) |
| ***H01H 3/30*** | (2006.01) |
| ***H01H 33/46*** | (2006.01) |
| *H01H 33/42* | (2006.01) |

(52) U.S. Cl.

CPC ..... *H01H 9/282* (2013.01); *H01H 3/20* (2013.01); *H01H 3/3047* (2013.01); *H01H 33/46* (2013.01); *H01H 33/42* (2013.01); *H01H 2239/032* (2013.01)

(58) Field of Classification Search

CPC ..... H01H 9/282; H01H 3/20
USPC ..... 200/43.11
See application file for complete search history.

(56) References Cited

U.S. PATENT DOCUMENTS

| | | | | |
|---|---|---|---|---|
| 1,803,163 | A * | 4/1931 | Beebe | H01H 21/50 200/329 |
| 5,288,958 | A * | 2/1994 | Grunert | H01H 9/22 200/329 |
| 7,583,170 | B2 | 9/2009 | Gogeissl et al. | |
| 2008/0079518 | A1 | 4/2008 | Gogeissl et al. | |

FOREIGN PATENT DOCUMENTS

| | | | |
|---|---|---|---|
| DE | 40114433 | A1 | 10/1991 |
| EP | 2737508 | A2 | 6/2014 |
| JP | 2004127802 | A | 4/2004 |
| JP | 2006049053 | A | 2/2006 |
| JP | 2008091333 | A | 4/2008 |
| JP | 2010154630 | A | 7/2010 |
| KR | 200420586 | Y1 | 7/2006 |
| KR | 101079791 | B1 | 11/2011 |
| KR | 101099232 | B1 | 12/2011 |
| KR | 101306467 | B1 | 9/2013 |

OTHER PUBLICATIONS

Korean Search Report for Application No. 2020150004227 dated Oct. 8, 2015, in 3 pages.
European Search Report for Application No. 16169338, dated Nov. 16, 2016, in 8 pages.

* cited by examiner

*Primary Examiner* — Edwin A. Leon
*Assistant Examiner* — Iman Malakooti
(74) *Attorney, Agent, or Firm* — Knobbe, Martens, Olson & Bear, LLP

(57) ABSTRACT

In some embodiments, a locking device for an operating mechanism of a gas insulated switchgear, capable of locking or unlocking operations of an operating mechanism of disconnecting switches and earthing switches of the gas insulated switchgear.

9 Claims, 14 Drawing Sheets

LOCKING DEVICE FOR OPERATING MECHANISM OF GAS INSULATED SWITCHGEAR

CROSS-REFERENCE TO RELATED APPLICATIONS

This application claims the benefit of Korean Patent Application No. 20-2015-0004227, filed on Jun. 24, 2015, in the Korean Intellectual Property Office, the disclosure of which is incorporated herein by reference in its entirety.

BACKGROUND

1. Technical Field

The present disclosure relates to a locking device for an operating mechanism of a gas insulated switchgear, and more particularly, a locking device for an operating mechanism of a gas insulated switchgear, capable of locking or unlocking operations of an operating mechanism of disconnecting switches and earthing switches of the gas insulated switchgear.

2. Description of the Related Art

In general, a gas insulated switchgear (GIS) is an electric device which is installed between a power source side and a load side of a circuit of an electric power system. The gas insulated switchgear switches a circuit on purpose in a normal usage state or safely interrupts current when a fault current such as a ground fault or a short-circuit occurs to thus protect such electric power system and a load device. The gas insulated switchgear is generally used for an ultra-high electric power system.

The gas insulated switchgear generally includes a bushing unit receiving electric energy (power) from a high voltage power source, a circuit breaker (CB), a disconnecting switch (DS), an earthing switch (ES), a moving unit, a controller and the like.

FIGS. 1 and 2 are planar and longitudinal sectional views illustrating a DS and ES unit and an operating mechanism 9 of a gas insulated switchgear according to the related art. The DS and ES unit includes a tank 1 and spacers 2, disconnecting switches 3, earthing switches 4 and three-position switches 5 all disposed in the tank 1, a driving shaft 6 installed at the operating mechanism 9, and a driven shaft 8 operating the 3-position switches 5. A link assembly 7 is provided between the driving shaft 6 and the driven shaft 8.

FIG. 3 is a perspective view of the link assembly 7 of FIG. 1. The link assembly 7 includes a driving shaft lever 7*a* receiving a driving force of the operating mechanism 9 through the driving shaft 6, a driven shaft lever 7*d* disposed with being spaced apart from the driving shaft lever 7*a* and transferring a force to the driven shaft 8, link rods 7*b* connecting the driving shaft lever 7*a* to the driven shaft lever 7*d* to transfer the force from the driving shaft lever 7*a* to the driven shaft lever 7*d*, and connection pins 7*c* rotatably connecting the driving shaft lever 7*a* or the driven shaft lever 7*d* to the link rods 7*b*.

FIG. 4 illustrates an operation of the link assembly 7. The driving shaft 6 is connected to the driving shaft lever 7*a*. Movable contacts 5*a* of the three-position switches 5 are coupled for each phase to the driven shaft 8 coupled to the driven shaft lever 7*d*. Also, fixed contacts 3*a* of the disconnecting switches DS and fixed contacts 4*a* of the earthing switches ES are illustrated. Here, the driven shaft 6, the movable contact 5*a*, the fixed contact 3*a* of each disconnecting switch DS and the fixed contact 4*a* of each earthing switch ES are merely conceptually illustrated for the sake of explanation. When a driving force of the operating mechanism 9 is transferred to the driving shaft lever 7*a* through the driving shaft 6, the link assembly 7 including the driving shaft lever 7*a*, the link rods 7*b* and the driven shaft lever 7*d* rotates the driven shaft 8. Accordingly, the movable contact 5*a* of each of the three-position switches 5 coupled to the driven shaft 6 is rotated or slid into one of a closed state of the disconnecting switch DS (DS closed state or position), a neutral (trip) state, and a closed state of the earthing switch ES (ES closed state or position).

FIGS. 5A and 5B, 6A and 6B, and 7A and 7B are views illustrating a case where the driving shaft is in the neutral state, a case where the disconnecting switch is in the closed state, and a case where the earthing switch is in the closed state, respectively, in relation to FIGS. 2 and 3.

Here, the link assembly 7 connecting the driving shaft 6 and the driven shaft 8 to each other has a simple quadric link structure. Also, the link assembly 7 merely serves to transfer the driving force of the operating mechanism 9 to the driven shaft 8 and is not provided with a separate safety device or a locking device. This may be likely to bring about the following problems.

First, while operating (or switching on) the gas insulated switchgear, when a user operates it in an unexpected way carelessly or due to misjudgment, damages on facilities or casualties may be caused.

When the operating mechanism is rotated excessively more or less than a normal rotation angle due to being defectively assembled or other causes, a poor contact (contact trouble) between the movable contact 5*a* and the fixed contacts 3*a* and 4*a* may be brought about, thereby lowering a product performance. In this instance, components may be damaged due to collision between the components.

In addition, when the driving shaft is disassembled or removed to repair or replace the operating mechanism which currently operates, the movable contact 5*a* may be freely rotated without a restriction due to a non-presence of a supporting structure, and abnormally comes in contact with the fixed contacts 3*a* and 4*a* on which current flows, which may be likely to cause an unexpected accident.

SUMMARY

Therefore, to obviate those drawbacks of the related art, an aspect of some embodiments of the present disclosure is to provide a locking device for an operating mechanism of a gas insulated switchgear, capable of preventing an accident, ensuring an assembly property and operation reliability of the device, and improving safety of maintenance, by restricting operations of a disconnecting switch and an earthing switch due to a user's carelessness.

To achieve these and other advantages and in accordance with the purpose of this disclosure, as embodied and broadly described herein, there is provided a locking device for an operating mechanism of a gas insulated switchgear, the locking device including a driving shaft lever connected to the operating mechanism to perform a rotation motion, first and second link rods coupled to upper and lower ends of the driving shaft lever, respectively, to transfer the motion, a driven shaft lever including upper and lower ends connected to the first and second link rods, respectively, to perform a rotation motion, and provided with a stopping groove on a part thereof, a supporter installed at a tank, a locking lever coupled to the supporter to perform a rotation motion or a parallel motion, the locking lever locking the motion of the driven shaft lever when being inserted into the stopping groove, and a driven shaft rotated by a force transferred by the driven shaft lever.

Here, the stopping groove may be provided in plurality, which are formed at positions corresponding to a closed state of a disconnecting switch, a neutral state and a closed state of an earthing switch, respectively.

Also, the supporter may include a base plate coupled to the tank, and a pair of side walls coupled with the locking lever.

The locking device may further include a lever pin inserted through the locking lever and serving as a rotation shaft of the locking lever.

A fixing plate restricting the motion of the locking lever may be coupled to an upper surface of one of the side walls.

A lock hole may be formed through a part of the fixing plate, and a lock that is latched through the lock hole may be provided.

A ring through which the lock is latched may be provided on an upper portion of another of the side walls.

A fixing pin may be provided to fix the fixing plate to the one side wall.

A screw hole may be formed through a part of at least one of the side walls, and a wing bolt may be inserted into the screw hole to lock the locking lever.

The locking lever may be configured as a rod movable in parallel between the side walls.

In a locking device for an operating mechanism of a gas insulated switchgear according to one exemplary embodiment of the present disclosure, a state of a link assembly can be locked by a locking unit provided at one side of the link assembly, and thus a change in a contact state may not occur even by a user's operation made randomly or by mistake, thereby ensuring stability of device and power system.

A normal operating state of a disconnecting switch/earthing switch can be determined on the basis of a coupled state between the link assembly and the locking unit.

A current state of the operating mechanism can be recognized on the basis of the coupled state between the link assembly and the locking unit, thereby preventing an operation made by mistake.

The locking unit may be provided with locking devices, such as a lock, a wing bolt and the like to fix a specific state, thereby preventing a random operation.

In addition, for repairing or replacing the operating mechanism which is currently operating, a situation that a movable contact is freely moved due to a detachment or removal of a driving shaft can be prevented, so as to prevent an abnormal contact between the movable contact and fixed contacts along which current flows, resulting in prevention of casualty or facility damage.

Further scope of applicability of the present disclosure will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this disclosure, illustrate exemplary embodiments and together with the description serve to explain the principles of the disclosure.

In the drawings.

DETAILED DESCRIPTION

Description will now be given of preferred configurations, with reference to the accompanying drawings, which is to explain in detail enough that those skilled in the art to which the present disclosure belongs can easily practice the disclosure. It should not be construed to limit the technical scope and spirits of the present disclosure.

Figure 1:
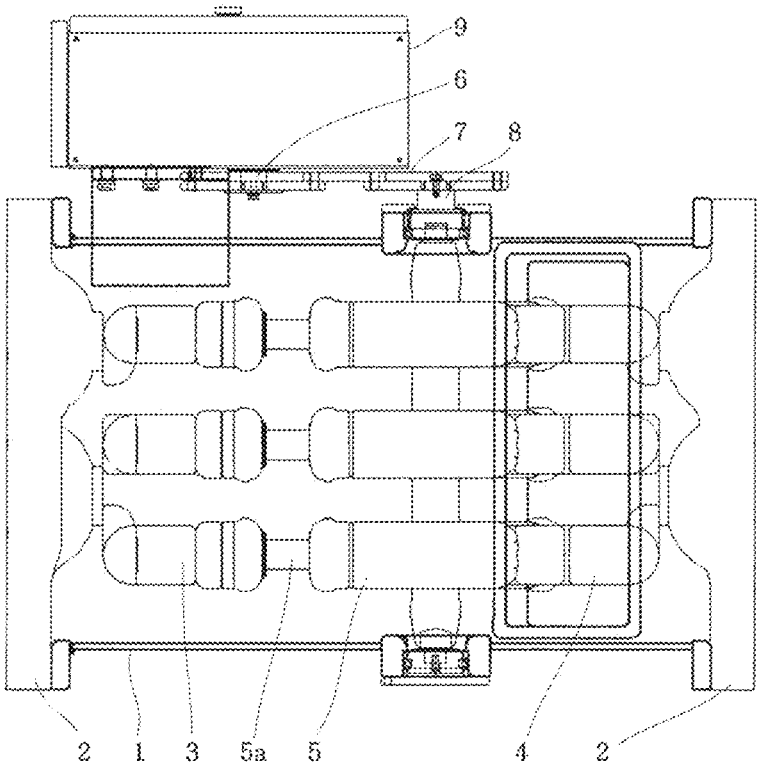
Fig. 1 Prior Art
FIG. 1 is a planar view of a disconnecting switch and earthing switch unit of a gas insulated switchgear according to the prior art.
Figure 2:
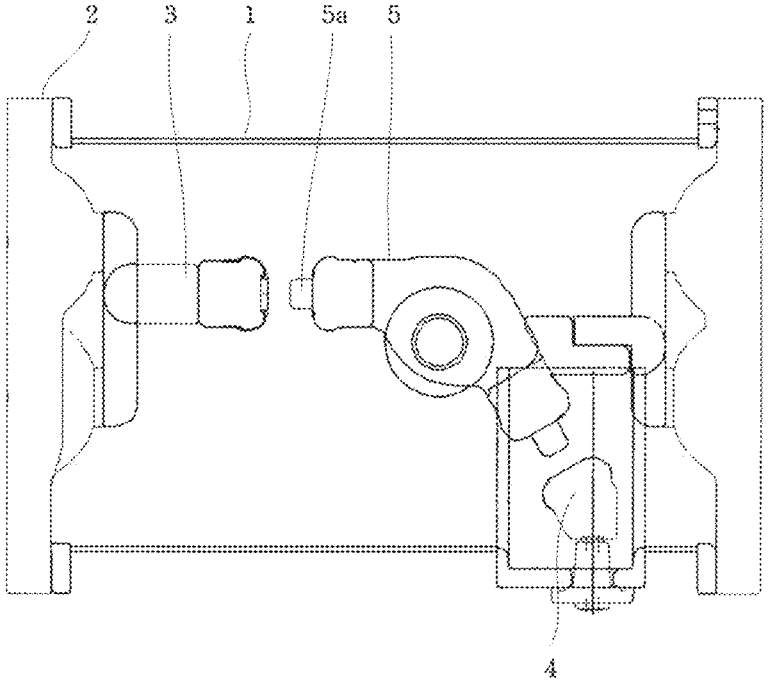
Fig. 2 Prior Art
FIG. 2 is a longitudinal sectional view of FIG. 1 according to the prior art.
Figure 3:
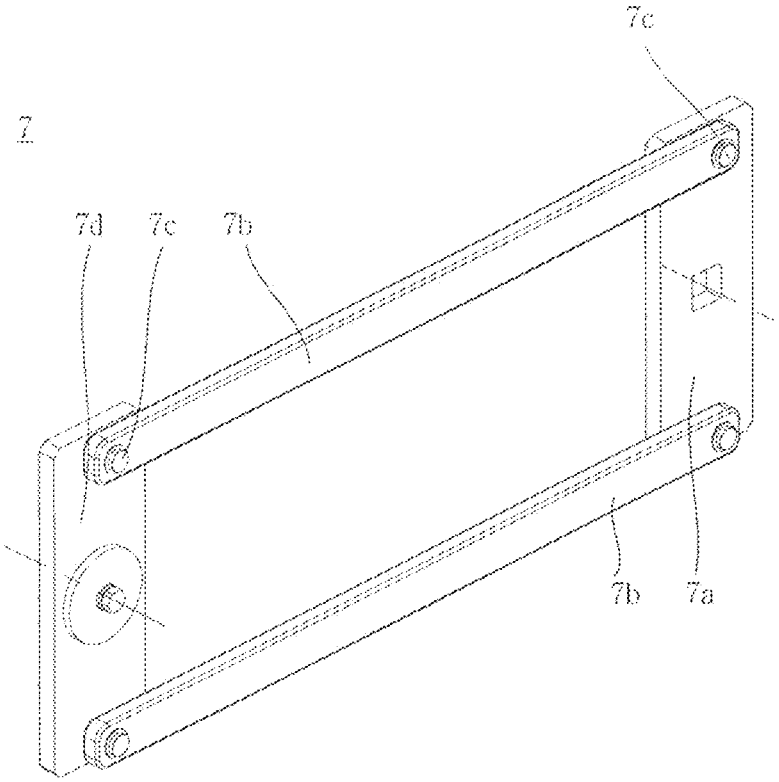
Fig. 3 Prior Art
FIG. 3 is a perspective view of a link assembly in FIG. 1 according to the prior art.
Figure 4:
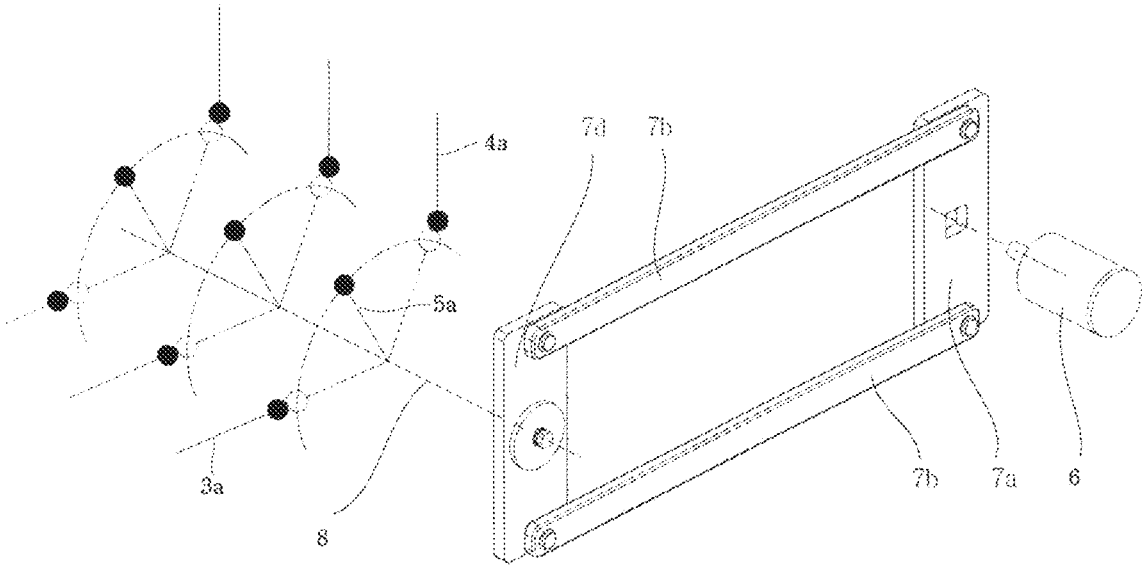
Fig. 4 Prior Art
FIG. 4 is an operation view of FIG. 3 according to the prior art.
Figure 5A:
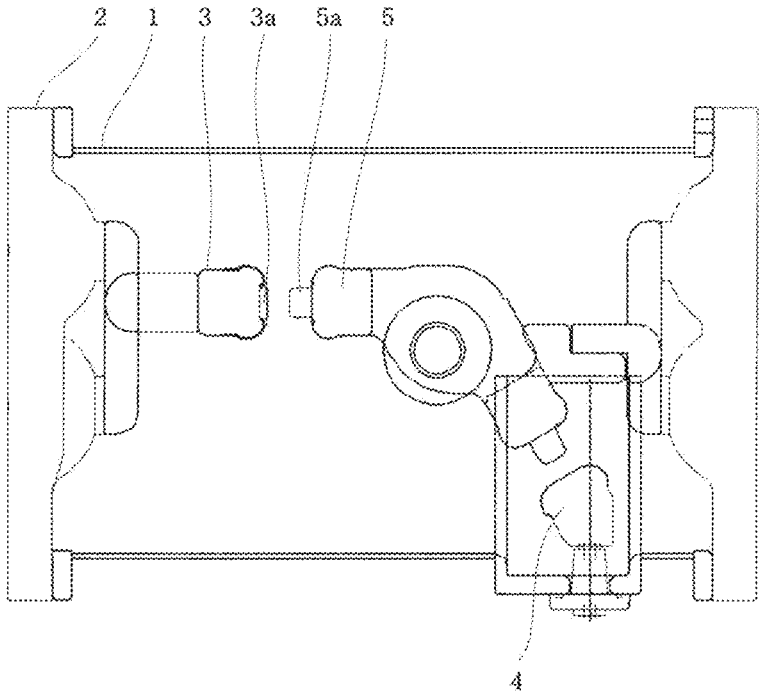
Fig. 5A Prior Art
FIGS. 5A and 5B are views illustrating a case where a driving shaft is placed in a neutral state according to the prior art, in relation to FIGS. 2 and 3.
Figure 5B:
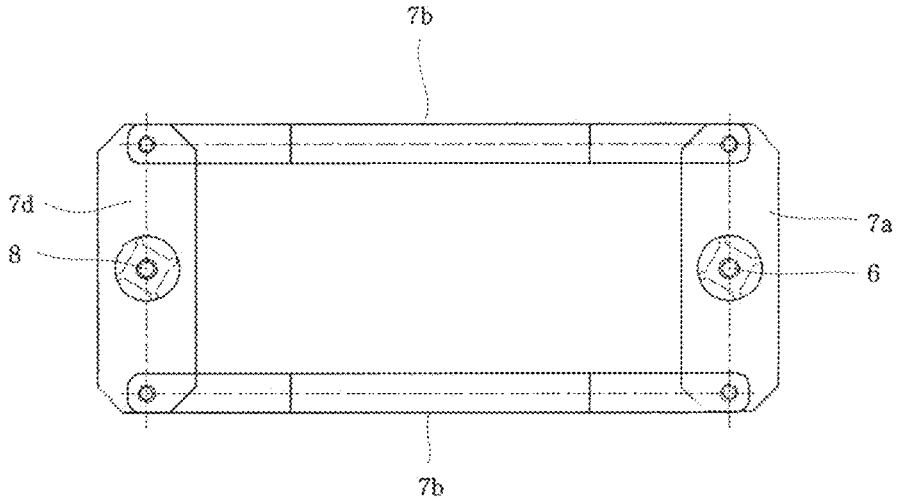
Fig. 5B Prior Art
Figure 6A:
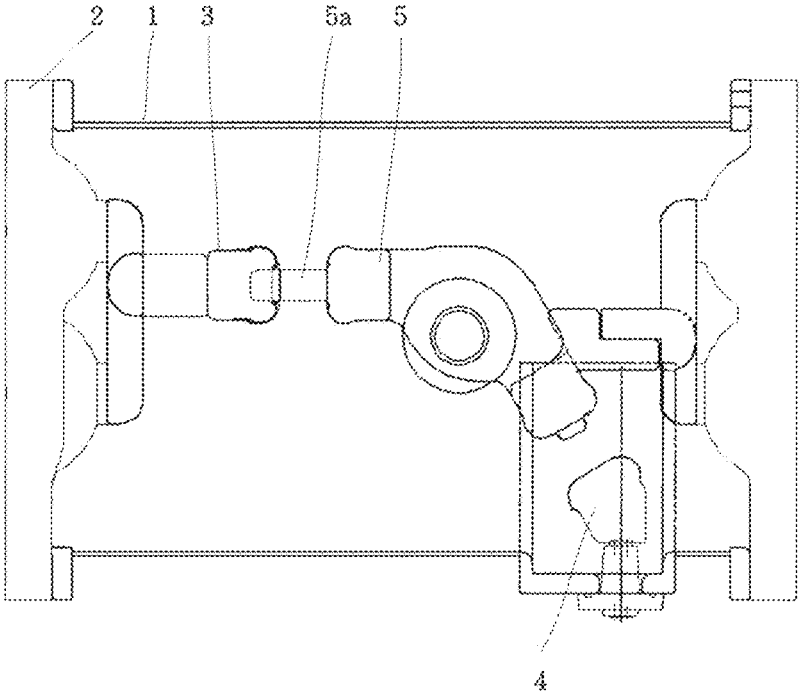
Fig. 6A Prior Art
FIGS. 6A and 6B are views illustrating a case where a disconnecting switch is placed in a closed state according to the prior art, in relation to FIGS. 2 and 3.
Figure 6B:
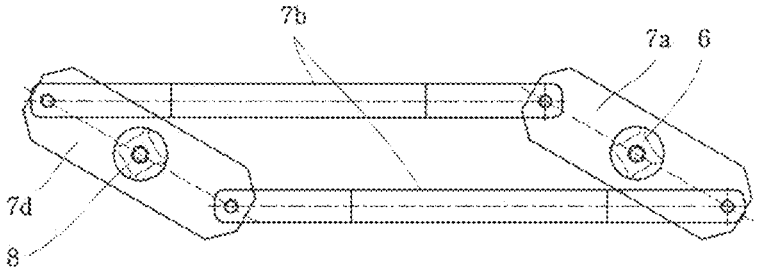
Fig. 6B Prior Art
Figure 7A:
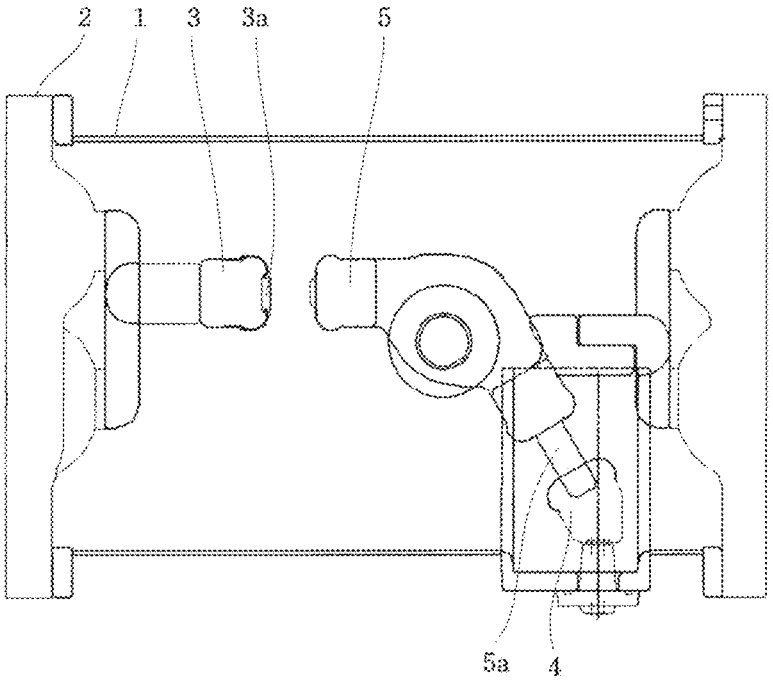
Fig. 7A Prior Art
FIGS. 7A and 7B are views illustrating a case where an earthing switch is placed in a closed state according to the prior art, in relation to FIGS. 2 and 3.
Figure 7B:
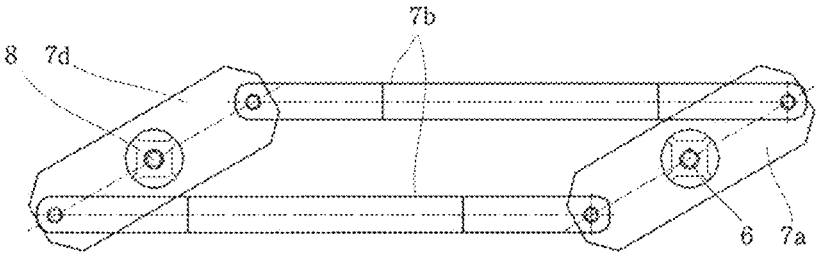
Fig. 7B Prior Art
Figure 8:
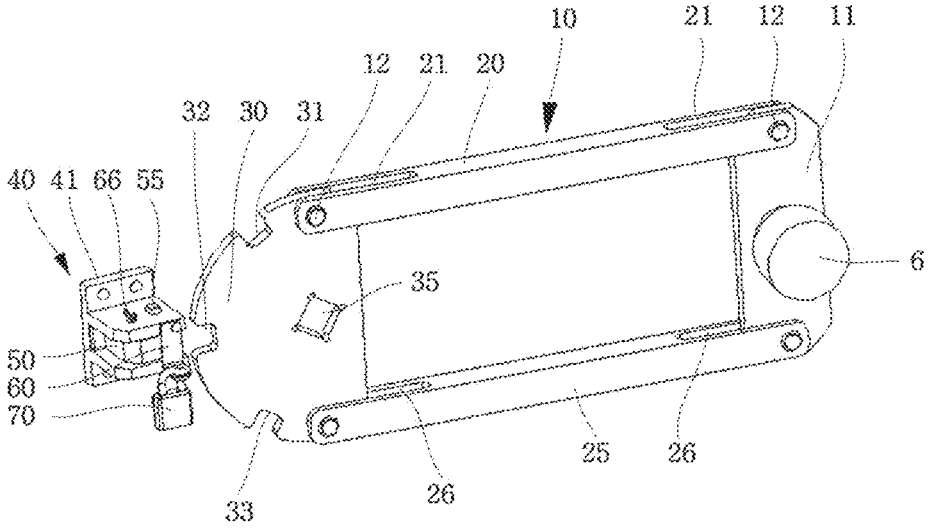
FIG. 8 is a perspective view illustrating a locking device for an operating mechanism of a gas insulated switchgear in accordance with some embodiments of the present disclosure.
Figure 9:
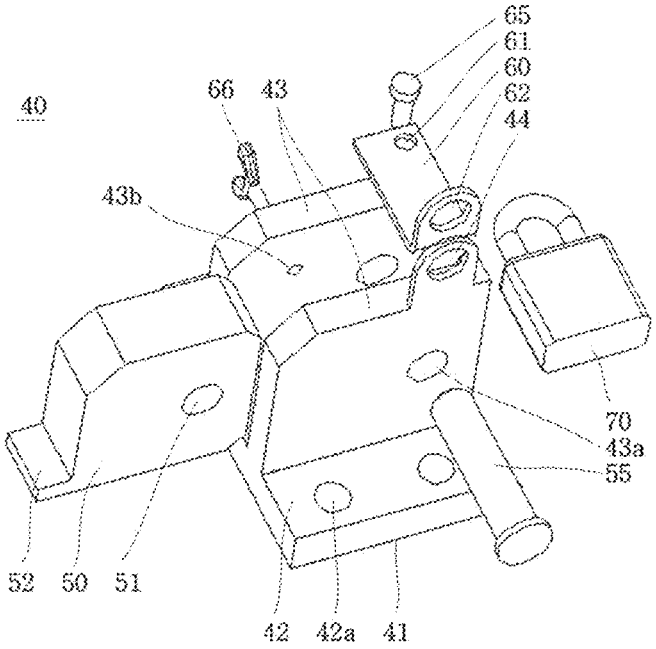
FIG. 9 is a disassembled perspective view of a locking unit in FIG. 8.
Figure 10:
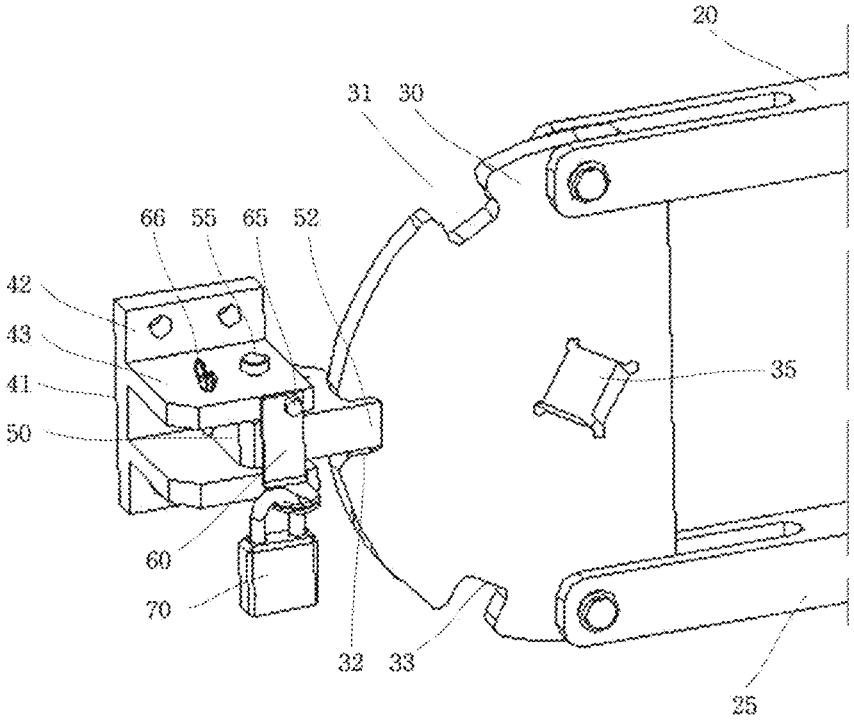
FIG. 10 is a view illustrating a locked state of a link assembly.
Figure 11:
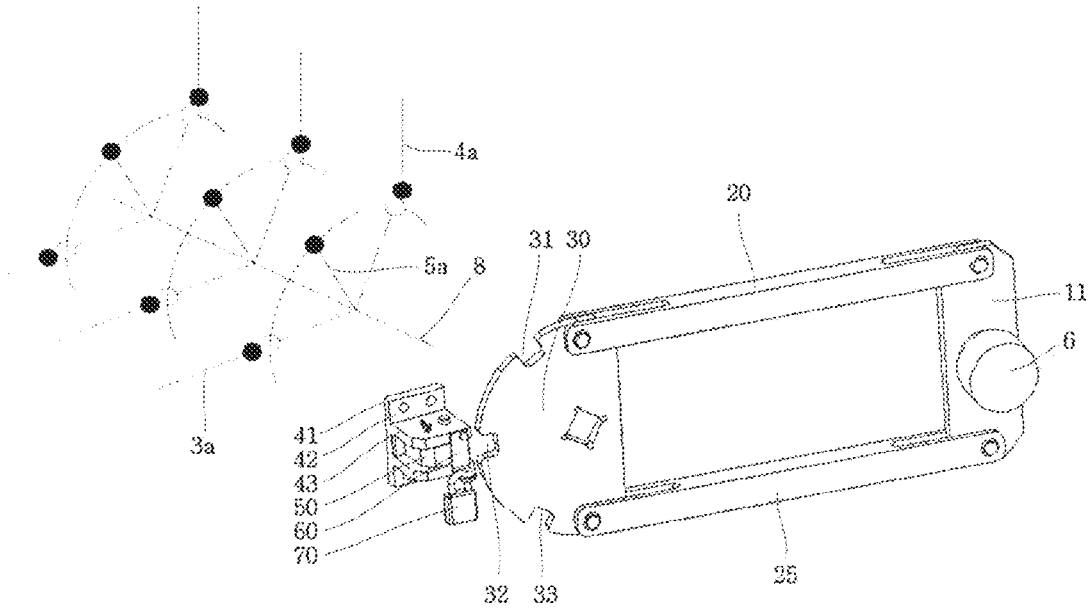
FIG. 11 is an operation view of the locking device for the operating mechanism of the gas insulated switchgear in accordance with the some embodiments of the present disclosure.

FIG. 8 is a perspective view illustrating a locking device for an operating mechanism of a gas insulated switchgear in accordance with some embodiments of the present disclosure, FIG. 9 is a disassembled perspective view of a locking unit in FIG. 8, FIG. 10 is a view illustrating a locked state of a link assembly, and FIG. 11 is an operation view of the locking device for the operating mechanism of the gas insulated switchgear in accordance with the some embodiments of the present disclosure.

Hereinafter, description will be given in detail of a locking device for an operating mechanism of a gas insulated switchgear in accordance with some embodiments of the present disclosure, with reference to the accompanying drawings. (Here, a disconnecting switch and earthing switch unit and an operating mechanism, except for a link assembly and a locking unit, have the same configuration to those according to the related art, so description thereof will be omitted. Also, the same reference numerals are used for the similar or same components to those in the related art, so they can be understood with reference to those drawings of the related art.)

The locking device for the operating mechanism of the gas insulated switchgear according to the some embodiments of the present disclosure may include a driving shaft lever 11 connected to the operating mechanism to perform a rotation motion, first and second link rods 20 and 25 coupled to upper and lower ends of the driving shaft lever 11, respectively, to perform a rotation motion and a parallel motion, a driven shaft lever 30 including upper and lower ends connected to the first and second link rod 20 and 25, respectively, to perform rotation motion, and provided with stopping grooves 31, 32 and 33 formed at a part thereof, a supporter 41 installed at a tank (enclosure), a locking lever 50 coupled to the supporter 41 to perform a rotation motion or a parallel motion and restricting a motion of the driven shaft lever 30 when being inserted into the stopping grooves 31, 32 and 33, and a driven shaft 8 rotated by a force transferred by the driven shaft lever 30.

The locking device for the operating mechanism of the gas insulated switchgear according to the some embodiments of the present disclosure may include a link assembly 10 and a locking unit 40 restricting a motion of the link assembly 10.

The link assembly 10 may be configured as a quadric link. The link assembly 10 may include a driving shaft lever 11 and a driven shaft lever 30 provided on left and right ends, respectively, and first and second link rods 20 and 25 provided on upper and lower ends thereof.

The driving shaft lever 11 may be formed in the shape of a flat plate. The driving shaft lever 11 may be rotatably coupled to one ends of the first and second link rods 20 and 25, respectively. The driving shaft lever 11 may be connected to the driving shaft 6 of the operating mechanism 9 and rotated by the driving force of the operating mechanism 9.

The first and second link rods 20 and 25 may be coupled to the upper and lower ends of the driving shaft levers 11, respectively. The one ends of the first and second link rods 20 and 25 may be coupled to the driving shaft lever 11 by coupling members 12, such as pins, rivets, bolts and the like, in a rotatable manner, not in a fixed manner. Split slits 21 and 26 in which the driving shaft lever 11 or the driven shaft lever 30 is inserted may be formed at both end portions of the first and second link rods 20 and 26, respectively. The split slits 21 and 26 may be formed at the both end portions of the first and second link rods 20 and 25, respectively, in a lengthwise direction. When viewing the first and second link rods 20 and 25 from a top, the first and second link rods 20 and 25 may be symmetrically formed, respectively, on the basis of the split slits 21 and 26. As the driving shaft lever 11 is inserted into the split slits 21 and 26, the coupled state between the first and second link rods 20 and 25 and the driving shaft lever 11 can be stably maintained, and a loss of the driving force transferred from the driving shaft lever 11 can be minimized. The first link rod 20 and the second link rod 26 may be arranged in parallel to each other.

The driven shaft lever 30 may be rotatably coupled to another ends of the first and second link rods 20 and 25, respectively. The first link rod 20 may be coupled to an upper end of the driven shaft lever 30, and the second link rod 25 may be coupled to a lower end of the driven shaft lever 30. The coupling characteristic between the driving shaft lever 11 and the first and second link rods 20 and 25 can be similarly or equally applied to the coupling between the driven shaft lever 30 and the first and second link rods 20 and 25.

The driven shaft lever 30 may be formed in the shape of a flat plate. A shaft hole 35 to which the driven shaft can be coupled may be formed through the driven shaft lever 30. The driven shaft lever 30 may have an outer surface that protrudes into a semicircular shape. A plurality of stopping grooves 31, 32 and 33 may be formed on the outer surface of the driven shaft lever 30. The plurality of stopping grooves 31, 32 and 33 may separately be referred to as a first stopping groove 31, a second stopping groove 32, and a third stopping groove 33, from top to bottom. Here, the stopping grooves 31, 32 and 33 may be formed to correspond to three positions (a DS-closed position, a neutral or trip position and an ES-closed position) of the three-position switch.

The stopping grooves 31, 32 and 33 may be located at positions spaced apart from one another by a uniform angle (e.g., 60°). That is, at a neutral position as illustrated in FIG. 8, the driven shaft lever 30 may be in a state without being brought into contact with both of the disconnecting switch and the earthing switch (i.e., the neutral or trip state), and the locking unit 140 may be inserted into the second stopping groove 32. If the driving shaft 6 is rotated by 60° in a counterclockwise direction, the first link rod 20 may be moved to left and the second link rod 25 may be moved to right such that the driven shaft lever 30 can be rotated by 60° in the counterclockwise direction. In this instance, the locking unit 40 can be inserted into the first stopping groove 31. If the driving shaft 6 is rotated by 60° in a clockwise direction, the first link 20 may be moved to right and the second link rod 25 may be moved to left such that the driven shaft lever 30 can be rotated by 60° in the clockwise direction. In this instance, the locking unit 40 can be inserted into the third stopping groove 33.

The locking unit 40 may be disposed to lock or unlock the movement of the link assembly 10. In detail, the locking unit 40 may be inserted into one of the stopping grooves 31, 32 and 33 of the driven shaft lever 30 to lock the movement of the link assembly 10 in a specific state, and unlock the link assembly 10 when it is not inserted into any of the stopping grooves 31, 32 and 33.

As one embodiment of the locking unit 40, the locking unit 40 may include as core components a supporter 41 and a locking lever 50. Also, the locking unit 40 may further include components, such as a lever pin 55 for coupling the locking lever 50 to the supporter 41, a fixing plate 60 for restricting a motion of the locking lever 50, a lock 70, a wing bolt 66, and the like.

The supporter 41 may be installed at the tank 1 and support the locking lever 50 such that the locking lever 50 can perform a parallel motion or a rotation motion. The supporter 41 may include a base plate 42 coupled to the tank 1, and a pair of side walls 43 coupled with the locking lever 50. The base plate 42 may be provided with a plurality of fixing holes **42*a* for coupling the base plate 42 to the tank 1. Each of the side walls 43 may be provided with a pin hole 43*a* through which the lever pin 55 is inserted. A ring 44 through which the lock 70 is latched may be provided at an upper portion of one of the side walls 43**.

The locking lever 50 may be installed at the supporter 41 and inserted into the stopping grooves 31, 32 and 33. The locking lever 50 is a component which directly locks the driven shaft lever 30. The locking lever 50 may be formed in the shape of a plate. The locking lever 50 may be provided with a pin hole 51 formed therethrough such that the lever pin 55 can be inserted therethrough. A protrusion 52 which is insertable into the stopping grooves 31, 32 and 33 may protrude from a part of the locking lever 50. The protrusion 52 may be formed in various shapes, taking into account of an operation characteristic of the locking lever 50, shapes of the stopping grooves 31, 32 and 33, and the like.

The lever pin 55 may be provided to rotatably install the locking lever 50 at the supporter 41. The lever pin 55 may be inserted sequentially through one of the pin holes 43*a* of the side walls 43, the pin hole 51 of the locking lever 50 and the other of the pin holes 43*a*. The locking lever 50 may be rotatable centering on the lever pin 55 as a shaft. When the locking lever 50 is rotated in a counterclockwise direction centering on the lever pin 55 as the shaft, the protrusion 52 which has been inserted in one of the stopping groove 31, 32, 33 may be separated from the one stopping groove (see FIG. 8). On the other hand, when the locking lever 50 is rotated in a clockwise direction, the protrusion 52 may be inserted into one of the stopping groove 31, 32, 33 (see FIG. 10).

Meanwhile, the fixing plate 60 which restricts the motion of the locking lever 50 may be disposed on an upper surface of another of the side walls 43. A pin hole 61 may be formed through a part of the fixing plate 60 such that the fixing plate 60 can be fixed to the another side wall 43 by a fixing pin 65.

A lock hole 62 may be formed through a part of the fixing plate 60 such that the lock 70 can be latched therethrough.

In the meantime, a screw hole 43*b* may be formed through a part of at least one of the side walls 43. The wing bolt 66 may be inserted through the screw hole 43*b* and lock the locking lever 50.

Although not illustrated separately, another embodiment may be implemented in a manner that the locking lever 50 is formed in a shape of a rod to be movable in parallel between the side walls 43. In this instance, the locking lever 50 may be inserted into or separated from the stopping groove 31, 32, 33 of the driven shaft lever 30 by the parallel motion.

Hereinafter, description will be given of an operation of the locking device for the operating mechanism of the gas insulated switchgear according to some embodiments, with reference to FIGS. 11 to 14.

When the driving shaft lever 11 is rotated clockwise or counterclockwise by the driving force transferred from the driving shaft 6, the first and second link rods 20 and 25 coupled to the upper and lower end portions of the driving shaft lever 11 are responsively moved. The first link rod 20 and the second link rod 25 are moved in opposite directions to each other to allow the driven shaft lever 30 to be moved clockwise or counterclockwise. In response to the movement of the driven shaft lever 30, the driven shaft 8 is rotated and accordingly the movable contact 5*a* is moved.

Operation positions of the movable contact 5*a* may be three positions of a DS-closed position, a neutral or trip position, and an ES-closed position. That is, the movable contact 5*a* may be located at a position contactable with the fixed contact 3*a* of the disconnecting switch DS, a position without being contactable with the fixed contacts 3*a* and 4*a*, and a position contactable with the fixed contact 4*a* of the earthing switch ES. Accordingly, a primary circuit may be switched into a conductive state, a short-circuit state, and an earthed state. Here, the closed position of the disconnecting switch DS, the neutral or trip position and the closed position of the earthing switch ES may be positions at which the locking lever 50 of the locking unit 40 is insertable into the first stopping groove 31, the second stopping groove 32 and the third stopping groove 33, respectively. Accordingly, the locking lever 50 of the locking unit 40 can be inserted into one of the stopping grooves 31, 32 and 33 at each position to fix the link assembly 10 and lock the locking unit 40 using the lock 70 or the wing bolt 66. This may allow for locking the link assembly 10 and also determining whether or not the operating mechanism properly operates by being placed correctly at each contact state.

Although not illustrated separately, a controller (not shown) may be provided to control an operating position of the movable contact 5*a*. The controller may control a driving force of the driving shaft 6 of the operating mechanism such that each of the stopping grooves 31, 32 and 33 of the driven shaft lever 30 can be accurately aligned with the position of the locking lever 50 of the locking unit 40. For example, the controller may control the locking lever 50 to be moved exactly by 60° each so as to be located at the DS-closed position, the neutral or trip position or the ES-closed position.

Figure 12:
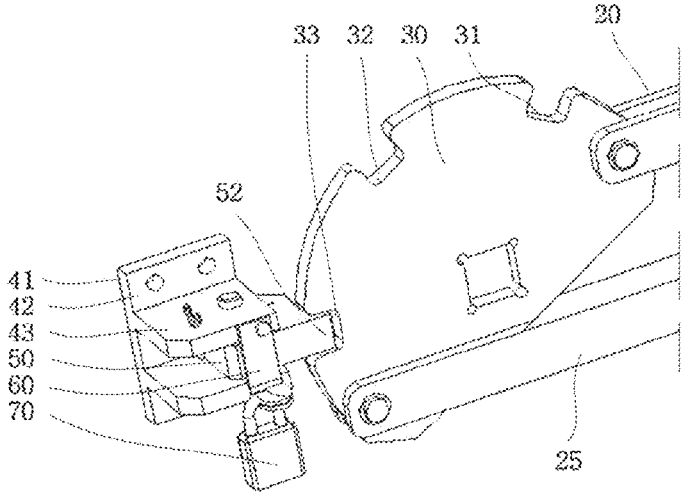
FIG. 12 is a view illustrating a normal operating state of the locking device for the operating mechanism of the gas insulated switchgear in accordance with the some embodiments of the present disclosure.

FIG. 12 illustrates a normal operating state among the operating states of the locking device for the operating mechanism of the gas insulated switchgear in accordance with some embodiments of the present disclosure. FIG. 12 illustrates a state that the driven shaft lever 30 is rotated exactly by 60° in the clockwise direction such that the movable contact 5*a* is brought into contact correctly with the fixed contact 4*a* of the earthing switch and the locking lever 50 is insertable into the third stopping groove 33. That is, the third stopping groove 33 of the driven shaft lever 30 is aligned with the locking lever 50 in a straight line.

Figure 13:
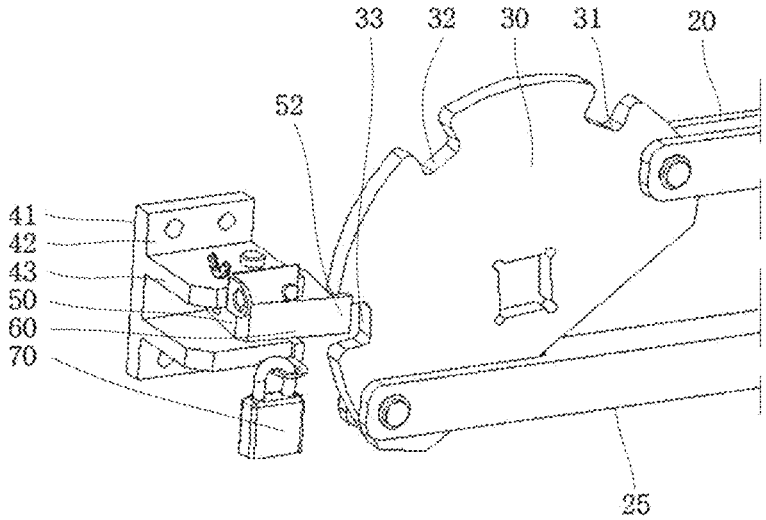
FIG. 13 is a view illustrating an incomplete operating state of the locking device for the operating mechanism of the gas insulated switchgear in accordance with the some embodiments of the present disclosure.

FIG. 13 illustrates an incomplete operating state among the operating states of the locking device for the operating mechanism of the gas insulated switchgear in accordance with the some embodiments of the present disclosure. FIG. 13 illustrates that the third stopping groove 33 of the driven shaft lever 30 is not aligned with the locking lever 50 of the locking unit 40 in the straight line. In this manner, when a rotation angle of the driven shaft lever 30 does not match (correspond to) a predetermined angle, the locking lever 50 may not be inserted into the stopping groove 31, 32, 33 and also the lock 70 cannot be latched. In addition, this may facilitate a user or operator to check with eyes that the movable contact 5*a* may not be in contact accurately with the fixed contact 4*a* of the earthing switch due to an inaccurate operation of the operating mechanism 8.

Figure 14:
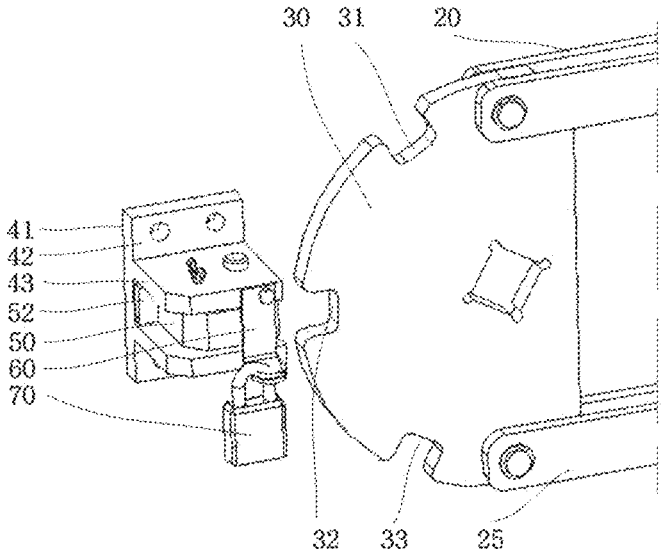
FIG. 14 is a view illustrating an unlocked state of the locking device for the operating mechanism of the gas insulated switchgear in accordance with the some embodiments of the present disclosure.

FIG. 14 illustrates a state that the locking lever 50 of the locking unit 40 is released from the link assembly 10, among the operating states of the locking device for the operating mechanism of the gas insulated switchgear in accordance with some embodiments of the present disclosure. Even in the released state, the lock 70 can be latched and thus the released state can be maintained and a loss of the lock can be prevented.

Figure 15:
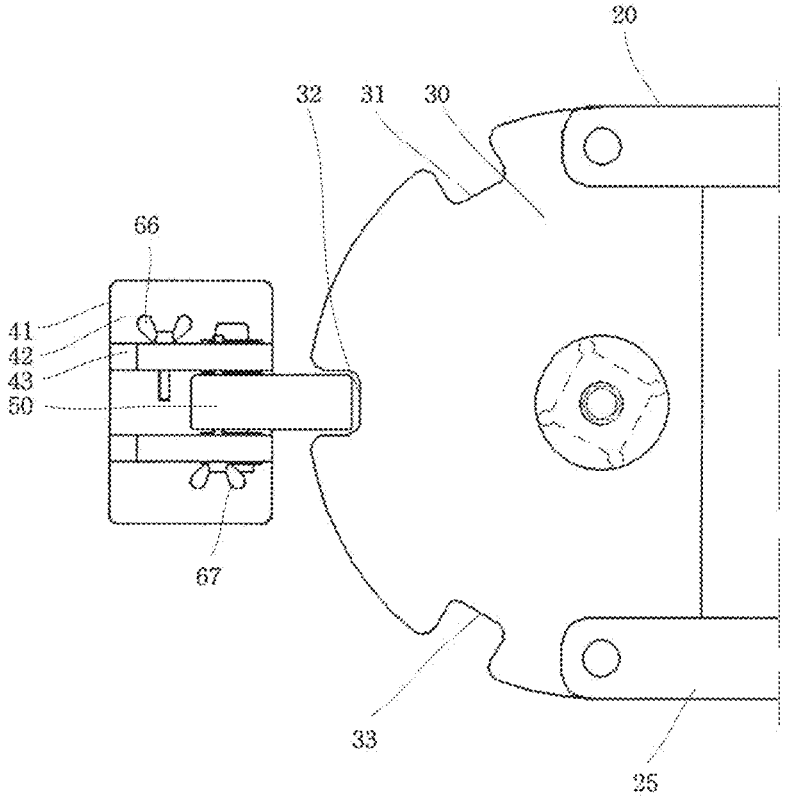
FIG. 15 is a planar view illustrating a locking device for an operating mechanism of a gas insulated switchgear in accordance with some embodiments of the present disclosure.

FIG. 15 is a planar view illustrating a locking device for an operating mechanism of a gas insulated switchgear in accordance with some embodiments of the present disclosure.

This embodiment illustrates that the locking unit 40 has the same configuration as that illustrated in the foregoing embodiment, excluding that the fixed plate 60 and the lock 70 are not employed and a wing bolt 67 is further provided to secure an inserted state of the locking lever 50.

In a locking device for an operating mechanism of a gas insulated switchgear according to some embodiments of the present disclosure, a locking unit provided at one side of a link assembly can lock a state of the link assembly, which may prevent a change in a contact state even by a user's operation made randomly or by mistake, resulting in ensuring stability of an electric power system.

A normal operating state of a disconnecting switch/earthing switch can be determined on the basis of a coupled state between the link assembly and the locking unit.

A current state of the operating mechanism can be recognized on the basis of the coupled state between the link assembly and the locking unit, thereby preventing an operation made by mistake.

The locking unit may be provided with locking devices, such as a lock, a wing bolt and the like to fix a specific state, thereby preventing a random operation.

In addition, for repairing or replacing the operating mechanism which is currently operating, a situation that a movable contact is freely moved due to a detachment or removal of a driving shaft can be prevented, so as to prevent an abnormal contact between the movable contact and fixed contacts along which current flows, resulting in prevention of casualty or facility damage.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A locking device for an operating mechanism of a gas insulated switchgear, the locking device comprising:

a driving shaft lever connected to the an operating mechanism configured to perform a rotation motion;

first and second link rods coupled to upper and lower ends of the driving shaft lever, respectively, to transfer the rotation motion;

a driven shaft lever including the upper and the lower ends connected to the first and the second link rods, respectively, configured to perform a the rotation motion, and provided with including a stopping groove on a part thereof;

a supporter installed at a tank;

a locking lever coupled to the supporter configured to perform the rotation motion, the locking lever configured to locking the motion of the driven shaft lever when being inserted into the stopping groove;

a driven shaft configured to rotated by a force transferred by the driven shaft lever; and a lever pin inserted through the locking lever and serving as a rotation shaft of the locking lever.

2. The device of claim 1, wherein the stopping groove is provided in plurality, formed at positions corresponding to a closed state of a disconnecting switch, a neutral state and a closed state of an earthing switch, respectively.

3. The device of claim 1, wherein the supporter comprises a base plate coupled to the tank, and a pair of side walls coupled with the locking lever.

4. The device of claim 3, wherein a fixing plate restricting the motion of the locking lever is coupled to an upper surface of one of the side walls.

5. The device of claim 4, wherein a lock hole is formed through a part of the fixing plate, and a lock that is latched through the lock hole is provided.

6. The device of claim 5, wherein a ring through which the lock is latched is provided on an upper portion of another of the side walls.

7. The device of claim 4, wherein a fixing pin is provided to fix the fixing plate to the one side wall.

8. The device of claim 3, wherein a screw hole is formed through a part of at least one of the side walls, and a wing bolt is inserted into the screw hole to lock the locking lever.

9. The device of claim 3, wherein the locking lever is configured as a rod movable in parallel between the side walls.

* * * * *